US005823861A

United States Patent [19]

Kobayashi et al.

[11] Patent Number: 5,823,861

[45] Date of Patent: Oct. 20, 1998

[54] SPIRAL-FLOW BARREL FINISHING MACHINE

[75] Inventors: Hisamine Kobayashi; Katsuhiro Izuhara; Akihito Fujishiro, all of Nagoya, Japan

[73] Assignee: Tipton Corp., Nagoya, Japan

[21] Appl. No.: 806,623

[22] Filed: Feb. 26, 1997

[30] Foreign Application Priority Data

Feb. 26, 1996 [JP] Japan ..... 8-038428

[51] Int. Cl.[6] ..... B24B 31/02

[52] U.S. Cl. ..... 451/326; 451/327; 451/328; 451/329; 451/330; 451/104; 451/117

[58] Field of Search ..... 451/326–330, 451/117, 104; 241/170, 284

[56] References Cited

U.S. PATENT DOCUMENTS

| | | | |
|---|---|---|---|
| 4,850,151 | 7/1989 | Ditscherlein | 451/327 |
| 4,884,372 | 12/1989 | McNeil | 451/327 |
| 4,958,776 | 9/1990 | Walther | 451/327 |
| 5,012,620 | 5/1991 | McNeil | 451/327 |
| 5,189,842 | 3/1993 | Kabayashi et al. | 451/326 |

FOREIGN PATENT DOCUMENTS

| | | |
|---|---|---|
| 27 05 445 | 8/1977 | Germany . |
| 33 32 787 | 3/1985 | Germany . |
| 43 24 132 | 1/1995 | Germany . |
| 05 038670 | 6/1993 | Japan . |
| 06 278010 | 2/1995 | Japan . |

*Primary Examiner*—Robert A. Rose
*Assistant Examiner*—George Nguyen
*Attorney, Agent, or Firm*—Wenderoth, Lind & Ponack, L.L.P.

[57] ABSTRACT

This invention relates to a spiral-flow barrel finishing machine having a cylindrical stationary metallic barrel equipped with a lining layer at a lower inside portion. A rotating barrel is equipped with a lining layer on a metallic rotational body and is loosely engaged with the lower part inside of the cylindrical stationary barrel so as to rotate freely. A constant clearance is kept between the inner wall of the stationary barrel and the outer wall of the rotating barrel, regardless of the temperature change and the moisture content change. A measure to allow for thermal expansion having a specific vertical width, properly corresponding to the vertical width of the clearance, is circularly arranged between the inner wall of the metallic stationary barrel and the outer wall of the lining layer on the metallic stationary barrel. This makes an allowance for thermal expansion of the lining layer on the stationary barrel toward wall side of the metallic stationary barrel.

10 Claims, 4 Drawing Sheets

SPIRAL-FLOW BARREL FINISHING MACHINE

FIELD OF THE INVENTION

This invention relates to a barrel finishing machine. Particularly, this invention relates to a spiral-flow barrel finishing machine comprising a cylindrical stationary barrel and a rotating barrel which loosely engaged with lower part and inside of said cylindrical stationary barrel so as to rotate freely, with an object to keep a constant clearance between inner wall of the stationary barrel and outer wall of the rotating barrel, not relating with the temperature change and the moisture content change.

PRIOR ART

There were some prior arts which disclose a variety of procedures for preventing a clearance between the stationary barrel and the rotating barrel of the spiral-flow barrel finishing machine from changing of its horizontal width, which is caused by thermal expansion. For example, Japanese patent under Provisional Publication No. 5-38670 and Japanese utility model under Provisional Publication No. 3-1130358 disclosed an invention and a device where a stopper is installed inside of lining layer on periphery of a rotating barrel to control deformation of the lining due to thermal expansion. Japanese utility model under Provisional Publication No. 57-53858 disclosed a device where a foreign material is used for a fine clearance at either a stationary barrel part opposed to the fine clearance or a rotating barrel part opposed to the fine clearance. And furthermore, Japanese utility model under Provisional Publication No. 51-62191 disclosed a device where a clearance between a stationary barrel and a rotating barrel is adjusted vertically.

These prior art procedures produce some negative effects as follows:

a) The procedure for installing a stopper within the lining layer on periphery of the rotating barrel can not afford to prevent either the clearance from shrinking due to thermal expansion in the severe usage for long time or durable life of the lining from shortening due to exposure of the stopper caused by abrasion of the lining layer. If the stopper is exposed by abrasion of the lining layer, it is necessary to re-install the lining layer. A bimetal type stopper may be available, but an increase in the cost is problematic.

b) The procedure for using a foreign material at either the stationary barrel part or the rotating barrel part may accelerate abrasion either the materials, resulting in its short durable life.

c) The procedure for a vertically adjusting a clearance requires an adjusting mechanism, so that it is problematic due to not only an increase in the cost but also poor sealability.

SUMMARY OF THE INVENTION

While studying direction about thermal expansion of the lining layer, which is installed on the inner wall of the stationary barrel, it has been found that, although the lining layer inside the metallic stationary barrel is to be expanded on heating toward the metallic stationary barrel, it is blocked to expand by the metallic wall of stationary barrel, so that this thermal expansion is forced to divert the direction toward center (inner) of the stationary barrel (resulting in reducing a horizontal width of clearance between inner wall of the lining layer on the stationary barrel and outer wall of the lining layer on the rotating barrel).

Thereupon, in accordance with this invention, as a measure to allow for thermal expansion of the lining layer installed in lower part inside the stationary barrel, a flexible layer having a specific vertical width, which can be deformed by thermal expansion of the lining layer installed in lower part inside the stationary barrel,is circularly arranged between inner wall of the metallic stationary barrel and outer wall of the lining layer installed in lower part inside the metallic stationary barrel, so that the heretofore mentioned problem has been resolved. In this specification, said flexible layer is called as a measure to allow for thermal expansion.

Namely, in a spiral-flow barrel finishing machine comprising a cylindrical metallic stationary barrel equipped with lining layer at lower part inside thereof and a rotating barrel equipped with lining layer at upper part of the metallic rotating body, keeping a specific clearance between these lining layers and said rotating barrel is loosely engaged with inside of said metallic stationary barrel so as to block lower part thereof, the spiral-flow barrel finishing machine of this invention is characterized in that a measure to allow for thermal expansion is circularly arranged between inner wall of the metallic stationary barrel and outer wall of the lining layer installed in lower part inside the metallic stationary barrel, having a specific vertical width corresponding to the vertical width of the clearance formed between inner wall of the lining layer on the metallic stationary barrel and outer wall of the lining layer on the rotating barrel.

In the above description, a measure to allow for thermal expansion may be made up by installing an easily deformable elastic layer or air layer, used by alone or combined, between inner wall of the metallic stationary barrel and outer wall of the lining layer installed in lower part inside the metallic stationary barrel.

Furthermore, it may be altered, a cylindrical metallic stationary barrel may be comprised by a cast-iron body and a polyurethane lining layer installed in lower part inside the said cast-iron body, and a measure to allow for thermal expansion may be made up by installing a continuous-porous material layer between inner wall of the said cast-iron stationary barrel and outer wall of the said polyurethane lining layer. Moreover, a measure to allow for thermal expansion may be made up by molding irregularities on outer wall of the lining layer facing to inner wall of the said cast-iron stationary body.

As described above, by circularly arranging a measure to allow for thermal expansion of the lining layer installed in lower part inside the metallic stationary barrel between inner wall of the metallic stationary barrel and outer wall of the lining layer installed in lower part inside the said metallic stationary barrel, the said lining layer may be feasible to expand freely on heating toward the wall side of the said metallic stationary barrel. Accordingly, the clearance between the stationary barrel and the rotating barrel of the spiral-flow barrel finishing machine can always be kept constant, not relating with the temperature change and the moisture content change.

In the above description, the vertical width of the said measure to allow for thermal expansion may be required to have a specific correlation with the vertical width of the clearance between inner wall of the lining layer installed in lower part inside the metallic stationary barrel and outer wall of the lining layer installed on rotating barrel, because at least by choosing the same size for both vertical widths, preferably larger size for the former, the said clearance can be adjusted to keep constant at every position across the vertical width of the said clearance.

Namely, the before described measure to allow for thermal expansion of the lining layer installed in lower part inside the metallic stationary barrel is circularly arranged, and its vertical width is preferable to be about 3-fold larger than the vertical width of the clearance to be adjusted. The reason of why is that adjustment of the clearance can be carried out more correctly and easily comparing with the case when the width is not large enough as 3-fold size. Also, even if the vertical width is chosen to be much larger than the 3-fold size, neither specific effects of adjustment of the clearance nor profits in manufacturing and cost are expected. Practically, vertical width of the measure to allow for thermal expansion is determined for preventing the size of clearance between the stationary barrel and the rotating barrel from being affected by the thermal expansion of the lining layer installed in lower part inside the metallic stationary barrel.

Furthermore, in the above description, it is preferable to locate the measure to allow for thermal expansion of the lining layer installed in lower part inside the metallic stationary barrel at almost the same height as the clearance between these barrels is positioned. By taking such as almost same height, it is feasible to effectively adjust the clearance while keeping the clearance uniformly across the every vertical direction.

Moreover, in the above description, thickness of the measure to allow for thermal expansion such as thicknesses of the elastic layer, air layer and continuous-porous material layer, or height or depth of irregularities in lining layer facing to inner wall of the metallic stationary barrel, are chosen to have equivalent absorptive power for thermal expansion of the lining layer installed in lower part inside the metallic stationary barrel, orientating to inner wall thereof.

For example, assuming that 0.5~1.5 mm of thermal expansion of the lining layer installed in lower part inside the metallic stationary barrel takes place at 60~70 degree C. temperature of the stationary barrel or the rotating barrel, at least 6 mm thickness of the measure to allow for thermal expansion is required. But, in case of the air layer, the 4 mm-thick layer may be enough to attain the purpose.

Then, since the lining layer on the rotating barrel expands on heating outwardly (toward narrowing the clearance between inner wall of the lining layer installed in lower part inside the metallic stationary barrel and outer wall of the lining layer on the rotating barrel) and the lining layer on the stationary barrel also expands on heating outwardly (toward widening the said clearance), the clearance between the stationary barrel and the rotating barrel remains constant (that is to say, it remains design size) in the case when no different amounts of the thermal expansion exist between these lining layers. Accordingly, in order to keep a constant clearance between the stationary barrel and the rotating barrel, it is desirable that the external thermal expansion of the lining layer on the rotating barrel (toward narrowing the clearance) and the external thermal expansion of the lining layer on the stationary barrel (toward widening the clearance) are kept at relatively the same rate at each temperature range.

In the above description, if the lining layer on the stationary barrel is thick and the lining layer on the rotating barrel is thin, as the temperature increases, amount of thermal expansion of the former lining layer becomes so large that some adjustment may be carried out to let a part of the former lining layer capable to expand inwardly by increasing deformation resistance of the measure to allow for thermal expansion (e.g. by using continuous-porous material layer). Thereupon, by choosing the measure to allow for thermal expansion (e.g. continuous-porous material layer) with required thickness, such as with 4 mm thickness, instead of usual 6 mm thickness, a method to preferably adjust the thermal expansion may be achieved; i.e. outward expansion of the lining layer on the stationary barrel is proceeded smoothly at the initial stage, and then two-way expansions such as outward and inward expansions of the lining layer on the stationary barrel are caused along with the increase of the amount of thermal expansion as the temperature increases according to the deformation resistance of the measure to allow for thermal expansion having a specific thickness such as with 4 mm thickness. In this method, the purpose may be achieved by adjusting not only thickness but also vertical width of the measure to allow for thermal expansion (e.g. continuous-porous material layer).

Further, another spiral-flow barrel finishing machine of this invention comprises a cylindrical stationary barrel and a rotating barrel equipped with lining layer at upper part of the metallic rotational body wherein a specific clearance is kept between inner wall at lower part of said cylindrical stationary barrel and outer wall of the lining layer on said rotating barrel which loosely engaged with inside of said cylindrical stationary barrel so as to block lower part thereof, characterized in that the cylindrical stationary barrel is made of the same material as that of the lining layer on the rotating barrel.

In this case, for example, provided that lining layer of the rotating barrel is made of polyurethane, the cylindrical stationary barrel may be made by polyurethane. By doing so, when the rotating barrel expands outward on heating, the stationary barrel expands outward at the same rate, so that the clearance between these barrels remains constant not relating with the temperature change and the moisture content change. Also, in this case, it is not necessary to install a special measure to allow for thermal expansion, such as elastic layer, air layer or continuous-porous material layer, or irregularities of lining layer facing inner wall of the metallic stationary barrel, between inner wall of the metallic stationary barrel and outer wall of the lining layer installed in lower part inside the metallic stationary barrel as the before described cases.

In accordance with this invention, since the clearance between stationary barrel and rotating barrel is always kept constant, as explained above, even if the clearance is determined as fine as allowable at the beginning of the design, any worrisome problem such as closing and meltdown of the clearance may be prevented. It gives another profitable outcome of being able to polish or finish materials in the barrel using fine workpieces, thin plate workpieces, fine abrasive chips without taking account of their blocking or fastening on the clearance between the stationary barrel and the rotating barrel.

In the case when continuous-porous material is used as a measure to allow for thermal expansion of the polyurethane lining, the said continuous-porous material having a specific vertical width and specific thickness is fixed on a definite part of inner wall of the metallic stationary barrel at the first, and then the lining layer may be equipped inside the metallic stationary barrel by the same molding procedure, which has been adopted in manufacturing conventional spiral-flow barrel finishing machine, without causing any further cost other than the cost required for manufacturing conventional spiral-flow barrel finishing machine.

The rotating barrel of spiral-flow barrel finishing machine of this invention has advantageous effect so that installation of a stopper in the lining layer of rotating barrel for controlling thermal expansion of the said lining layer, as described in prior art, and thinning of a lining layer on the stationary barrel are not necessary. Hitherto, since thick lining layer of the stationary barrel yields large amount of inward expansion on heating, the upper thickness of lining layer on the stationary barrel has been limited.

According to the present invention, the thickness of lining layer on the stationary barrel may be increased comparing to that of conventional spiral-flow barrel finishing machine, the spiral-flow barrel finishing machine of the present invention may be used for a long time, since it takes long time till the lining layer on the stationary barrel is worn off. Therefore, the life span of spiral-flow barrel finishing machine may be increased, and it may provide a cost merit comparing to the structure of prior art in which the stopper is installed in the lining layer of rotating barrel.

EXAMPLE 1

A preferable embodiment of this invention will be described hereinafter by using accompanying drawings.

Figure 1:
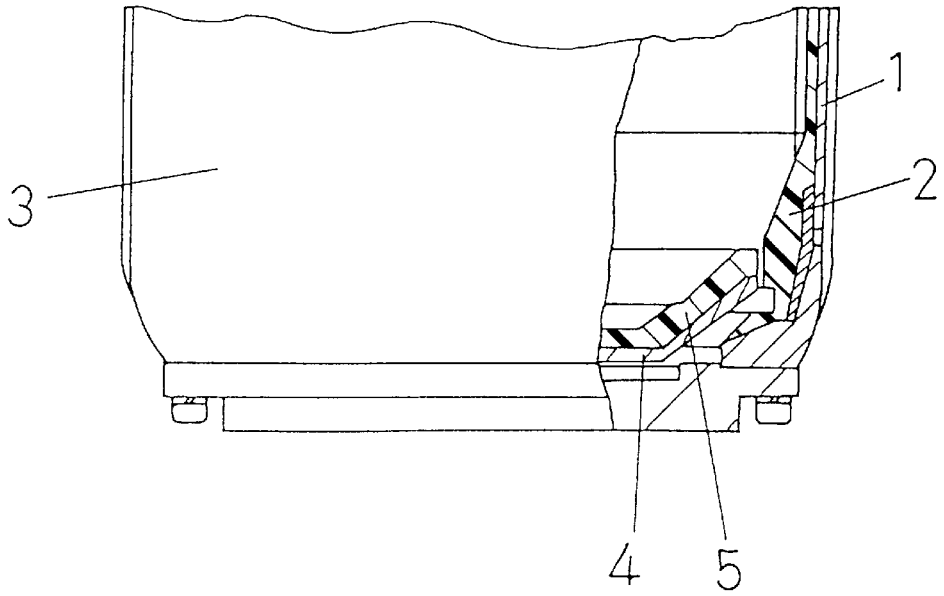
FIG. 1 shows a front view, partially in cross section, of a preferred embodiment of this invention.
Figure 2:
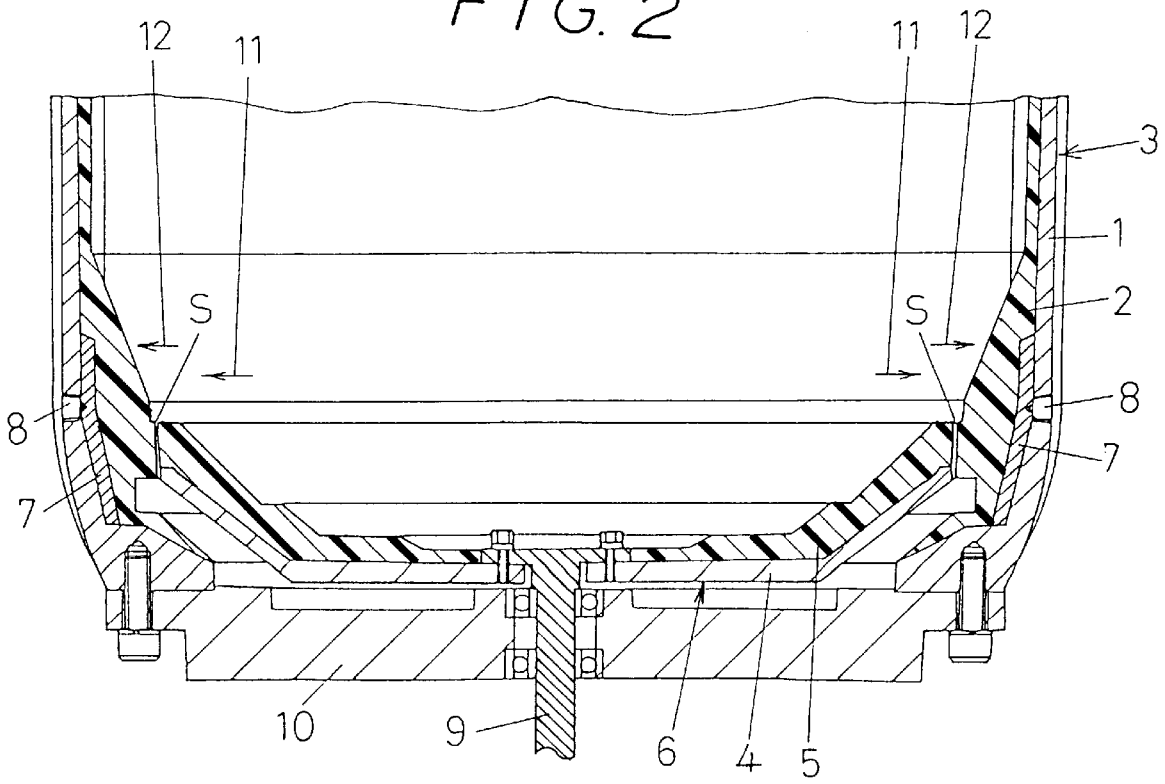
FIG. 2 shows an enlarged sectional view of the preferred embodiment illustrated in FIG. 1, with certain parts omitted.

As shown in FIG. 1 and FIG. 2, a cast-iron stationary barrel 1 whose inside and lower part is integrated with polyurethane lining layer 2 is referred to as stationary barrel 3. In this stationary barrel 3, a continuous-porous neoprene rubber plate 7 with a specific thickness (e.g. 6 mm) was circularly arranged between inner wall at lower part of the cast-iron stationary barrel 1 and outer wall of the polyurethane lining layer 2 (FIG. 1). This continuous-porous neoprene rubber plate 7 is called as a measure to allow for thermal expansion. Meanwhile, a cast-iron rotational barrel 4 equipped with polyurethane lining layer 5 at upper part thereof to block bottom part of the stationary barrel 3 is referred to as rotating barrel 6 (FIG. 2).

Vertical width of the neoprene rubber plate 7 is, for example, 70 mm. The size of vertical width of neoprene rubber plate 7 is determined according to the size of vertical width of clearance S between stationary barrel 3 and rotating barrel 6. Anyhow, the sizes of vertical width and thickness of neoprene rubber plate 7 are determined under the condition that the size of clearance S between stationary barrel 3 and rotating barrel 6 is stabilized or kept almost constant at every time, not relating with the thermal expansions of the polyurethane lining layer 2 and the polyurethane lining layer 5.

The rotating barrel 6 is loosely engaged with lower part inside the stationary barrel 3 so as to rotate freely and oppose to each other forming a fine clearance S (e.g. 0.1~1 mm) (FIG. 2). In this embodiment, the vertical width of the clearance S between stationary barrel 3 and rotating barrel 6 is, for example, 20 mm. As shown in FIG. 1 and FIG. 2, the neoprene rubber plate 7 is located at almost same height as the clearance S is positioned.

In FIG. 2, an air vent 8 is used for venting the occluded air, which was occluded in the continuous-porous neoprene rubber plate 7, when the continuous-porous neoprene rubber plate 7 is deformed by thermal expansion of the polyurethane lining layer 2. Also, in FIG. 2, numerals 9 and 10 illustrate rotation axis and supporting bottom of the stationary barrel 3, respectively.

In this embodiment, while the barrel 6 filled with workpieces and abrasive chips is rotating, temperatures of the stationary barrel 3 and the rotating barrel 6 increase (e.g. around 60 degree C.) as the progress of the finishing process, wherein the polyurethane lining layer 5 of the rotating barrel 6 expands on heating to the arrow direction 11 (outward) resulting in narrowing clearance S, on the other hand, the lining layer 2 of the stationary barrel 3 expands on heating to the arrow direction 12 (toward inner wall of the cast-iron stationary barrel 1), resulting in broadening clearance S.

In this case, if the effects of thermal expansion of these lining layers 2, 5 on the clearance S are compensated by each other, the clearance S always remains constant. On the other hand, if thermal expansion of the polyurethane lining layer 5 is smaller than that of the polyurethane lining layer 2, the clearance S becomes wider.

Therefore, the clearance S can be kept constant, even if the barrel finishing machine is used for long time under severe conditions by determining the thicknesses of polyurethane lining layers 2 and 5, and the vertical width and thickness of continuous-porous neoprene rubber plate 7 in order to adjust the effects of thermal expansions of these lining layers 2 and 5 on the clearance S may be compensated by each other.

EXAMPLE 2

Figure 3:
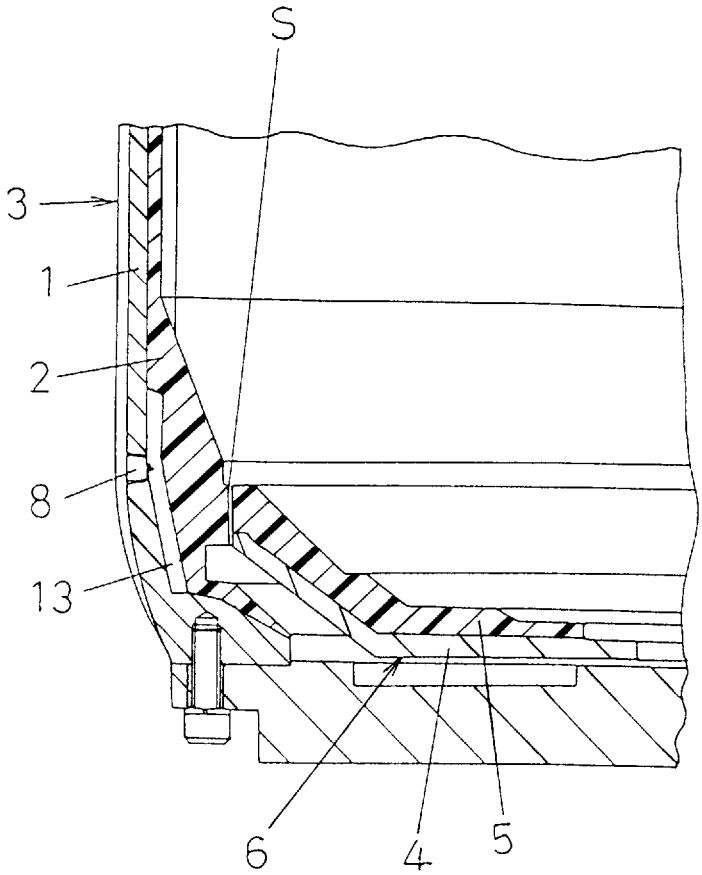
FIG. 3 shows an enlarged sectional view of the second preferred embodiment, with certain parts omitted.

The embodiment of FIG. 3 is carried out by using an air layer 13, in place of the continuous-porous neoprene rubber plate 7 in Example 1, wherein the air layer 13 is, for example, set as 3~4 mm thick and 5~7 cm vertical width. These sizes of thickness and vertical width of air layer may be varied depending upon the condition.

Figure 4:
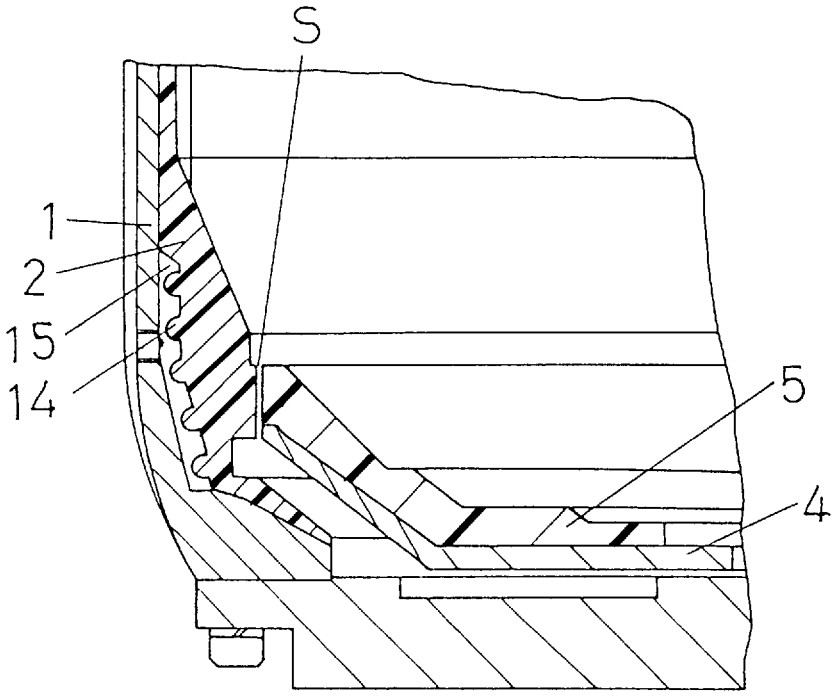
FIG. 4 shows an enlarged sectional view of the third preferred embodiment, with certain parts omitted.
Figure 5:
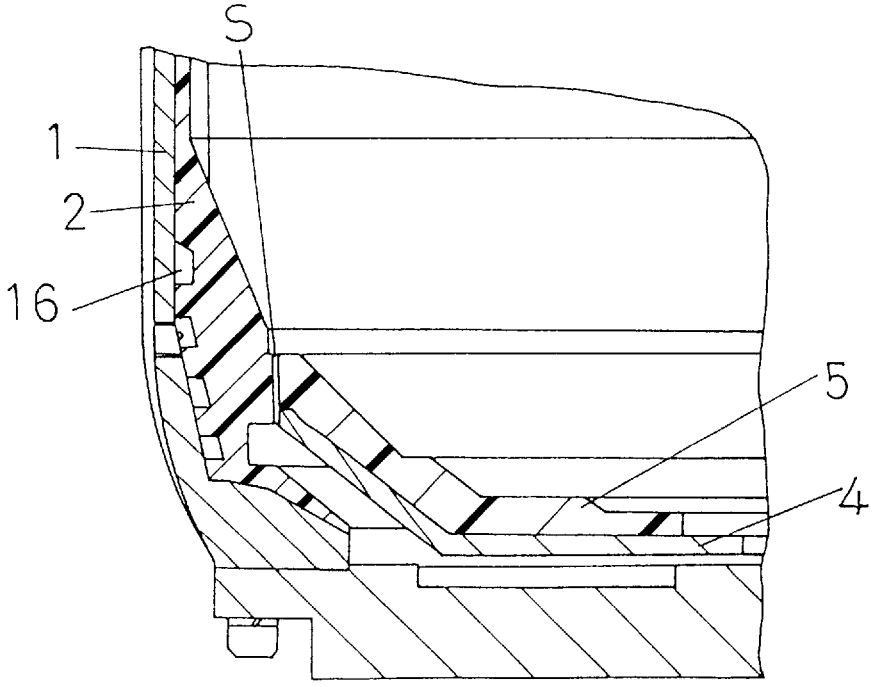
FIG. 5 shows an enlarged sectional view of the fourth preferred embodiment, with certain parts omitted.
Figure 6:
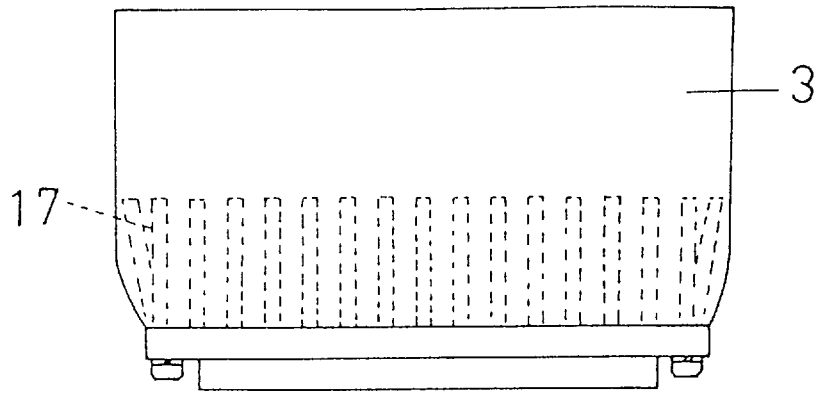
FIG. 6 shows an enlarged sectional view of the fifth embodiment, with certain parts omitted.

Also, the same effect is expected by forming outer wall of polyurethane lining layer 2 in irregularities such as forming concave parts 15 and convex parts 14 on outer face of the polyurethane lining layer 2 as illustrated in FIG. 4, or by forming circular slits 16 (FIG. 5) or longitudinal slits 17 (FIG. 6).

The vertical width, and the height or depth of the said irregularities 14, 15, 16, 17 may be chosen to have equivalent absorptive power for thermal expansion of polyurethane lining layer 2 toward the inner wall of stationary barrel 1.

Figure 7:
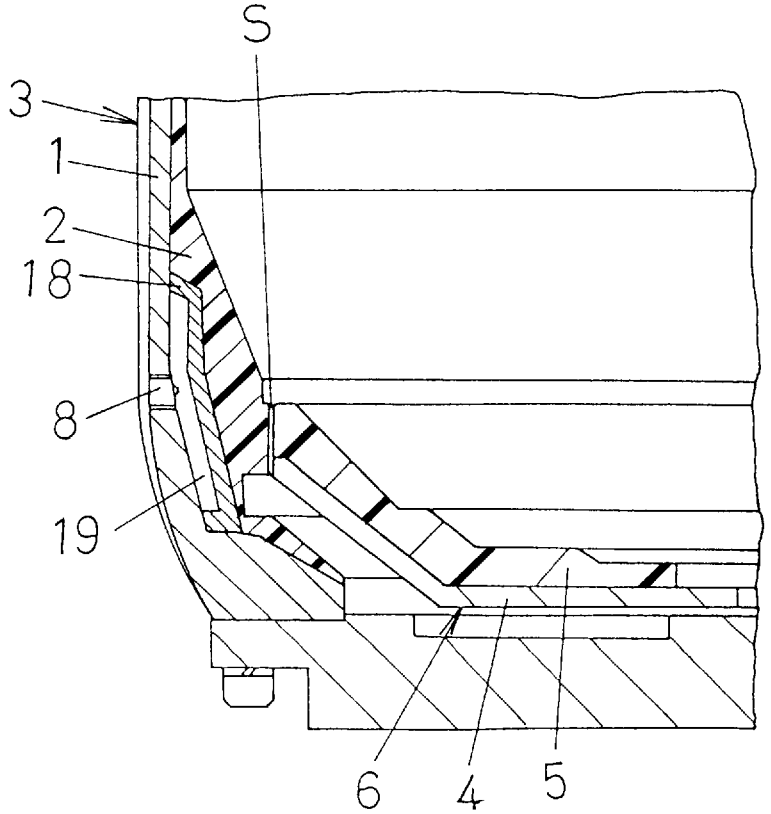
FIG. 7 shows an enlarged sectional view of the sixth preferred embodiment, with certain parts omitted.

Furthermore, provided that a continuous-porous neoprene rubber plate 18 and an air layer 19 are arranged in combination as shown in FIG. 7, the same effect is expected.

Although the present invention has been described with reference to the particular preferred embodiments, it should be understood that various changes and modifications may be made within the spirit and scope of the invention as defined in the appended claims.

What is claimed is:

1. A spiral-flow barrel finishing machine, comprising:

a metallic cylindrical stationary barrel having an inside having a lower part, said metallic cylindrical stationary barrel having an inner wall and a first lining layer on said lower part, and said first lining layer having an inner wall and an outer wall;

a rotating barrel comprising a metallic rotational body, said metallic rotational body having an upper part provided with a second lining layer, and said second lining layer having an outer wall, wherein said first and second lining layers have a specific clearance between said inner and outer walls thereof, said specific clearance having a vertical width, and wherein said rotating barrel is loosely engaged with the inside of said metallic stationary barrel so as to block said lower part; and a measure for allowing for thermal expansion arranged annularly between said inner wall of said metallic stationary barrel and said outer wall of said first lining layer and having a specified vertical width that corresponds to the vertical width of said specific clearance.

2. The spiral-flow barrel finishing machine of claim 1, wherein said measure for allowing for thermal expansion comprises at least one easily deformed layer selected from the group consisting of an elastic layer and an air layer, between said inner wall of said metallic stationary barrel and said outer wall of said first lining layer.

3. The spiral-flow barrel finishing machine of claim 1, wherein:

said metallic stationary barrel comprises a cast-iron stationary barrel and said first lining layer comprises a polyurethane lining layer; and said measure for allowing for thermal expansion comprises a continuous porous material layer between said cast-iron stationary barrel and said polyurethane lining layer.

4. The spiral-flow barrel finishing machine of claim 1, wherein:

said measure for allowing for thermal expansion comprises irregularities formed on said outer wall of said first lining layer facing said inner wall of said metallic stationary barrel.

5. A spiral-flow barrel finishing machine, comprising:

a cylindrical stationary barrel having an inner wall and a lower part;

a rotating barrel that comprises a metallic rotational body having an upper part and a lining layer at said upper part, said lining layer having an outer wall; and wherein said rotating barrel is loosely engaged with said cylindrical stationary barrel so as to block said lower part of said cylindrical stationary barrel and such that a specific clearance is defined between said inner wall of said cylindrical stationary barrel at said lower part thereof and said outer wall of said lining layer; and wherein said cylindrical stationary barrel and said lining layer are made of the same material such that said specific clearance is maintained substantially the same upon thermal expansion of said lining layer and said cylindrical stationary barrel during use of said spiral-flow barrel finishing machine.

6. A spiral-flow barrel finishing machine, comprising:

a metallic cylindrical stationary barrel having an inside having a lower part, said metallic cylindrical stationary barrel having an inner wall and a first lining layer on said lower part, and said first lining layer having an inner wall and an outer wall;

a rotating barrel comprising a metallic rotational body, said metallic rotational body having an upper part provided with a second lining layer, and said second lining layer having an outer wall, wherein said first and second lining layers have a clearance between said inner and outer walls thereof, and wherein said rotating barrel is loosely engaged with the inside of said metallic stationary barrel so as to block said lower part; and a means for allowing for thermal expansion of said first and second lining layers while maintaining said clearance substantially the same during use of said spiral-flow barrel finishing machine, said means being arranged annularly between said inner wall of said metallic stationary barrel and said outer wall of said first lining layer.

7. The spiral-flow barrel finishing machine of claim 6, wherein said means for allowing for thermal expansion comprises at least one easily deformed layer selected from the group consisting of an elastic layer and an air layer, between said inner wall of said metallic stationary barrel and said outer wall of said first lining layer.

8. The spiral-flow barrel finishing machine of claim 6, wherein:

said metallic stationary barrel comprises a cast-iron stationary barrel and said first lining layer comprises a polyurethane lining layer; and said means for allowing for thermal expansion comprises a continuous porous material layer between said cast-iron stationary barrel and said polyurethane lining layer.

9. The spiral-flow barrel finishing machine of claim 6, wherein:

said means for allowing for thermal expansion comprises irregularities formed on said outer wall of said first lining layer facing said inner wall of said metallic stationary barrel.

10. A spiral-flow barrel finishing machine, comprising:

a cylindrical stationary barrel having an inner wall and a lower part;

a rotating barrel that comprises a metallic rotational body having an upper part and a lining layer at said upper part, said lining layer having an outer wall;

wherein said rotating barrel is loosely engaged with said cylindrical stationary barrel so as to block said lower part of said cylindrical stationary barrel and such that a specific clearance is defined between said inner wall of said cylindrical stationary barrel at said lower part thereof and said outer wall of said lining layer; and means for allowing thermal expansion of said cylindrical stationary barrel and said lining layer such that said clearance is maintained substantially constant during use of said spiral-flow barrel finishing machine, said means comprising having said cylindrical stationary barrel and said lining layer made of the same material.

* * * * *